US005206633A

United States Patent [19]

Zalph

[11] Patent Number: 5,206,633

[45] Date of Patent: Apr. 27, 1993

[54] SELF CALIBRATING BRIGHTNESS CONTROLS FOR DIGITALLY OPERATED LIQUID CRYSTAL DISPLAY SYSTEM

[75] Inventor: Walter N. Zalph, Boca Raton, Fla.

[73] Assignee: International Business Machines Corp., Armonk, N.Y.

[21] Appl. No.: 747,217

[22] Filed: Aug. 19, 1991

[51] Int. Cl.[5] ..... G09G 3/36

[52] U.S. Cl. ..... 340/784; 340/793; 340/715; 358/10

[58] Field of Search ..... 340/784 B, 784 D, 784 F, 340/793, 767, 812, 784, 715; 358/10, 139, 168, 236

[56] References Cited

U.S. PATENT DOCUMENTS

| | | | |
|---|---|---|---|
| 5,041,821 | 8/1991 | Onitsuka et al. | 340/784 |
| 4,571,584 | 2/1986 | Suzuki | 346/784 B1 |
| 4,743,096 | 5/1988 | Yakal et al. . | |
| 4,746,970 | 5/1988 | Hosokawa et al. | 358/10 |
| 4,766,430 | 8/1988 | Gillette et al. | 340/793 |
| 4,833,464 | 5/1989 | Di Santo et al. | 340/793 |
| 4,921,334 | 5/1990 | Akodes . | |
| 4,944,578 | 7/1990 | Denison . | |
| 5,001,481 | 3/1991 | Lee | 358/236 |
| 5,030,947 | 7/1991 | Dieudonne et al. | 340/793 |
| 5,061,920 | 10/1991 | Nelson | 340/784 |

FOREIGN PATENT DOCUMENTS

| | | | |
|---|---|---|---|
| 0313331 | 4/1989 | European Pat. Off. | 340/784 |
| 0420727 | 4/1991 | European Pat. Off. | 340/784 |
| 2237400 | 5/1991 | United Kingdom | 340/784 |

*Primary Examiner*—Alvin E. Oberley
*Assistant Examiner*—Gin Goon
*Attorney, Agent, or Firm*—Daniel E. McConnell; Douglas R. McKechnie

[57] ABSTRACT

A TFT LCD display has a PEL matrix in which the drain lines of the different TFTs are supplied with different drain voltages to achieve a preset number of gray scales. The different drain voltages are set during calibration through use of a test PEL having substantially the same characteristics as the PELs viewable by a user. The characteristics of the test PEL are first measured and the values of drain voltages for achieving the different gray scales are mathematically derived from the measurements. The specific manner in which this is done is by placing a photodiode next to the test PEL and measuring the photodiode outputs corresponding to different drain voltage inputs to construct a unique transmissivity versus drain voltage for the subject monitor.

5 Claims, 3 Drawing Sheets 10
12
MICRO PROCESSOR
MATH COPROCESSOR

16
BIC
14
18
20
SCSI ADAPTER
22
24
SCSI HD
14D
41
45
DATA BUFFER
30
NVRAM
37
39
MAIN MEMORY
DISPLAY PROGRAM
ROM
POST
38
40
ROM
32
72
FLOPPY
73
46
IOC
PRINTER
74
KEYBOARD
76
78
MOUSE
80
SERIAL
SPEAKER
81
36
42
44
48
GRAPHICS CONTROLLER
LCD SUBSYSTEM
62
60
TEXT AND GRAPHICS VRAM
50
CONNECTOR

CLK
HSYNC
VSYNC
DATA
COLUMN TIMING AND CONTROL
84
70
DATA
VSCAN
86
LATCHED SHIFT REGISTERS
88-1
n
88-2
88-J
94
92
90-1
90-2
90-J
LL1
LL2
LL2 n
D/A1
D/A2
D/A2 n
DEMUX
DEMUX
DEMUX
CALIBRATION SYSTEM
96
68-1
68-2
68-J
100
98
66-1
66-2
69
ROW DRIVERS
CLK
TFT LCD
( j cols. by k rows)
66-K
64
HSCAN
CLK
HSYNC
VSYNC
ROW TIMING AND CONTROL
82

SELF CALIBRATING BRIGHTNESS CONTROLS FOR DIGITALLY OPERATED LIQUID CRYSTAL DISPLAY SYSTEM

FIELD OF THE INVENTION

This invention relates to improvements in digitally operated, thin film transistor (TFT) liquid crystal display (LCD) systems. More particularly, the invention relates to improvements in LCD brightness controls whereby an LCD is self calibrating and maximizes the number of brightness or gray scale levels.

BACKGROUND OF THE INVENTION

LCDs are commonly formed with a matrix of picture elements or PELs each containing a TFT coupled with liquid crystal material that transmits light in accordance with control signals applied to the TFT. The transmissivity or apparent brightness of the PEL is a function of the polarization of the liquid crystal material which is a function of the magnitude of the drain voltage and of the time during which such voltage is applied in conjunction with a gate signal. After the control signals have been applied, the parasitic capacitance to the TFT temporarily stores a DC value which must be refreshed or recharged to maintain the desired transmissivity over a longer period of time.

With LCD monitors or displays, it is difficult to obtain many precise steps in the transmissivity between a PEL being fully "On" or "Off". By applying different levels or values of drain voltage, a given PEL can transmit different amounts of light and appear to a user to have different brightness levels of "gray scales". Traditional methods for achieving various gray scales include pulse width modulation (PWM) and pulse amplitude modulation (PAM). In PWM, a fixed drain voltage is applied for different periods of time determined by the pulse width. In PAM, different drain voltages are applied for the same amount of time (fixed pulse width). PAM is preferred for high end TFT LCD monitors. Using PAM, the average polarization of a PEL varies with the PEL's light transmission percentage (transmissivity; to produce gray toning. With PAM, pell transmissivity is directly controlled by the analog value of the voltage applied to the PELs drain line while the PELs gate line is activated by a digital gate signal.

Current LCD manufacturing processes do not yield completely uniform or predictable ranges of PEL transmissivities versus applied PEL drain bias voltages. The basic shape of a transmissivity curve is well understood, but the absolute values thereof vary widely within the displays produced in a given manufacturing run. Human visual perception further complicates the situation because such perception "sees" gray scales in a logarithmic manner as opposed to a linear gradation. This means that to increase the number of gray scales by a factor "n" requires increases in contrast ratios of $(\sqrt{2})^n$ where the contrast ratio CR is the ratio of the maximum transmissivity to the minimum transmissivity.

For a given manufacturing run, the values of the different drain voltages to be used for PAM can be preset to the same values for all displays, or each display could be individually factory calibrated. The problem with the former method is that there might be wide variations in the looks of the different displays and/or the number of gray scale levels has to be limited in order to produce acceptable levels. The latter method increases the cost of displays and does not take into account the aging of components such that initial settings may not be satisfactory over time.

SUMMARY OF THE INVENTION

One of the objects of the invention is to provide an improved LCD TFT display having a built-in, self calibrating system for defining a plurality of gray scales.

Another object of the invention is to provide a self calibrating system for a TFT LCD which is operated to periodically calibrate the display and achieve a maximum number of gray scale levels between fully On and Off levels.

Briefly, in accordance with the invention, a TFT LCD display has a PEL matrix in which the drain lines of the different TFTs are supplied with different drain voltages to achieve a preset number of gray scales. The different drain voltages are set during calibration through use of a test PEL having substantially the same characteristics as the PELs viewable by a user. The characteristics of the test PEL are first measured and control values of drain voltages for achieving the different gray scales are derived from the measurements.

DRAWINGS

Other objects and advantages of the invention will be apparent from the following description taken in connection with the accompanying drawings wherein.

DETAILED DESCRIPTION

Figure 1:
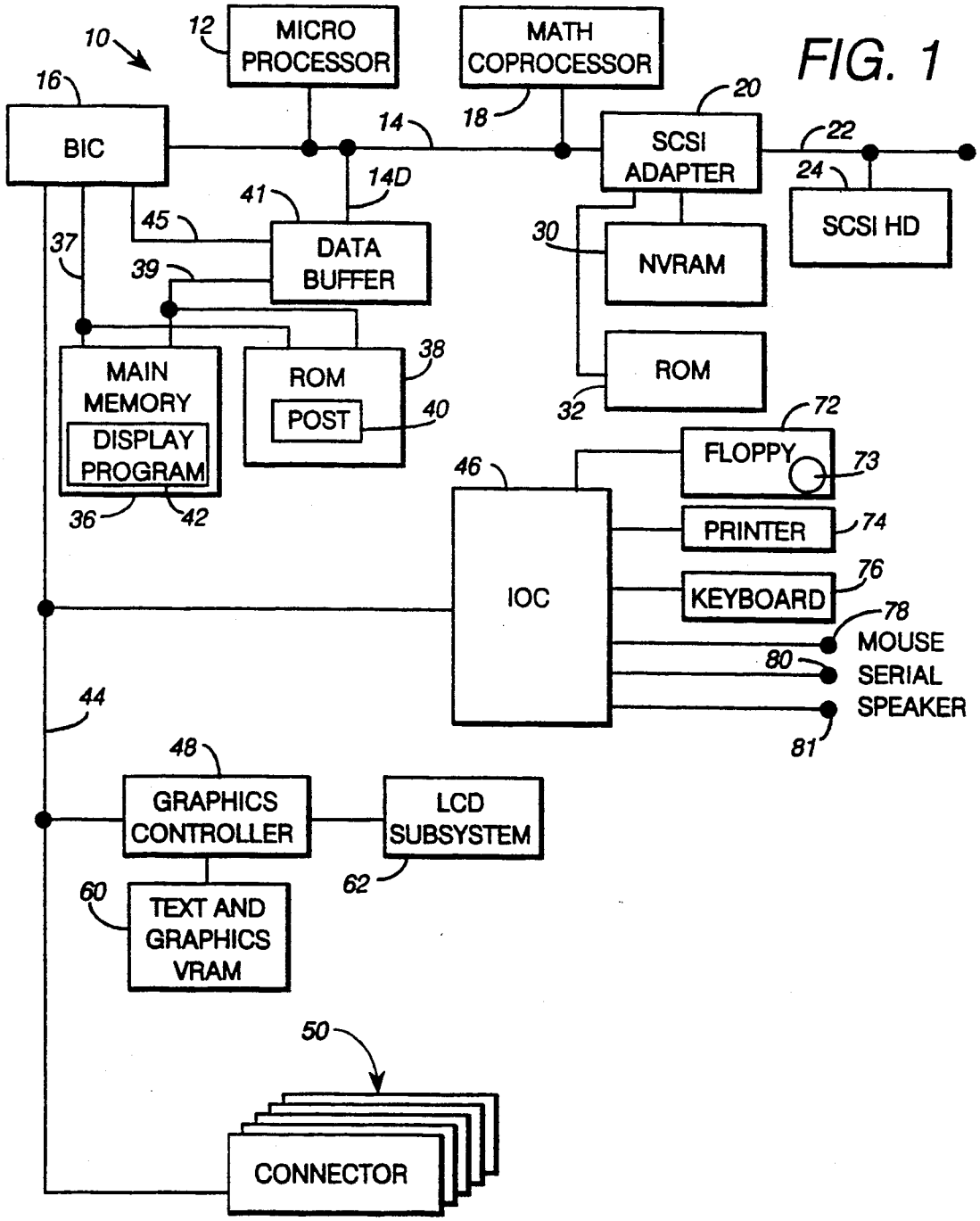
FIG. 1 is a block diagram of a data processing system embodying the invention.

Referring now to the drawings, and first to FIG. 1, there is shown an exemplary data processing system embodying the invention, the system comprising a personal computer 10 operable under an operating system such as PC DOS or OS/2 to execute application programs. Computer 10 comprises a microprocessor 12 connected to a local bus 14 which, in turn, is connected to a bus interface controller (BIC) 16, a math coprocessor 18, and a small computer system interface (SCSI) adapter 20. Microprocessor 12 is preferably one of the family of 80xxx microprocessors, such as an 80386 microprocessor, and local bus 14 includes conventional data, address, and control lines conforming to the architecture of such processor. Adapter 20 is also connected to a SCSI bus 22 which is connected to a SCSI hard drive (HD) 24 designated as the C:drive, the bus also being connectable to other SCSI devices (not shown). Adapter 20 is also connected to a NVRAM 30 and to a read only memory (ROM) 32.

BIC 16 performs two primary functions, one being that of a memory controller for accessing a main memory 36 and a ROM 38. Main memory is a dynamic random access memory (RAM) that comprises a plurality of single, in-line, memory modules (SIMMS) and stores programs and data for execution by microprocessor 12 and math coprocessor 18. Memory 36 stores a display program 42 which sends data to the display subsystem, in the manner hereinafter described. ROM 38 stores a POST program 40. POST program 40 performs the primary test, i.e. POST, of the system when computer 10 is restarted by turning the power on or by a keyboard reset. An address and control bus 37 connects BIC 16 with memory 36 and ROM 38. A data bus 39 connects memory 36 and ROM 38 with a data buffer 41 that is further connected to data bus 14D of bus 14. Control lines 45 interconnect BIC 16 and data buffer 41.

The other primary function of BIC 16 is to interface between bus 14 and an I/0 bus 44 designed in conformance with Micro Channel (MC) architecture. Bus 44 is further connected to an input/output controller (IOC) 46, a graphics controller 48, and a plurality of MC connectors or slots 50. Controller 48 is further connected to video RAM (VRAM) 60 and an LCD subsystem 62.

IOC 46 controls operation of plurality of I/0 devices including a floppy disc drive 72 designated as the A:-drive, a printer 74, and a keyboard 76. Drive 72 comprises a controller (not shown) and a removable floppy disc or diskette 73. IOC 46 also is connected to a mouse connector 78, a serial port connector 80, and a speaker connector 81 which allow various optional devices to be connected into the system.

Figure 2:
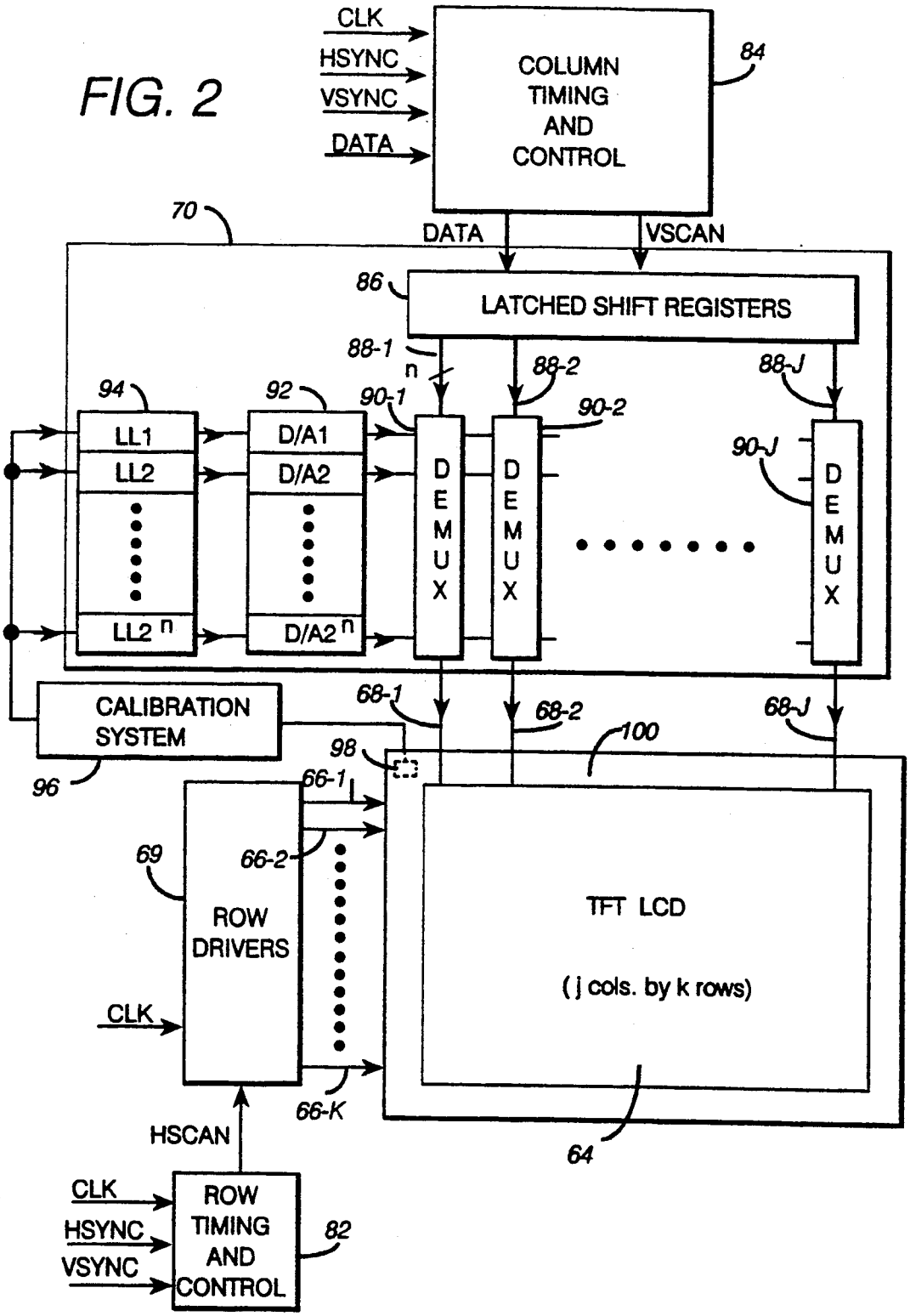
FIG. 2 is a block diagram of a portion of the LCD subsystem shown in FIG. 1.

Referring to FIG. 2, LCD subsystem 62 comprises an TFT LCD 64 having a matrix of PELs arranged in "j" columns of "k" rows. A typical matrix has 640 columns and 480 rows. A plurality of gate lines 66-1 through 66-k are connected to the gates of all the PELS in the respective rows to supply gate signals to the rows of PELs. A plurality of drain lines 68-1 through **68-*j* are connected to the drain lines of the respective PELS in the different columns to supply drain voltage signals to the columns of PELs. Gate lines 66 are driven by row drivers 69 and drain lines 68 are driven by column drivers 70. An individual PEL is activated by the coincidence of a gate signal and a drain voltage signal or level on the gate line 66 and drain line 68** respectively connected to the individual PEL.

Row drivers 68 are constructed and operated in a conventional manner by a CLK signal and a horizontal scan (HSCAN) signal supplied thereto, the latter signal coming from row timing and control circuit 82. A CLK signal is supplied to circuit 82 along with a horizontal synchronizing (HSYNC) signal and a vertical synchronizing (VSYNC) signal. The latter two signals are also fed into a column timing and control circuit 84 along with a CLK signal and DATA signals. Such DATA signals come from controller 48 and VRAM 60 and include in each signal a digital value representing a gray scale level to be displayed on an individual PEL. Circuits 82 and 84 operate synchronously to repetitively and rapidly cause the gate signals and drain signals to be supplied to LCD 64 and thereby create a display of the desired data for viewing by a user.

Column drivers 70 comprises a plurality of latched shift registers 86 that receive a vertical scan (VSCAN) and DATA signals from circuits 84 and output onto a plurality of lines 88-1 through **88-*j* a series of digital control signals of "n" bits each. The number of bits "n" is chosen or predetermined in accordance with how many ($2^n$) gray scale or brightness levels are desired and obtainable within the display technology. Lines 88 are respectively connected to a plurality of demultiplexers (DEMUXes) 90-1 through 90-*j* which in turn have outputs respectively connected to drain lines 68**.

A plurality of $2^n$ level latches (LL) 94 have outputs respectively connected to inputs of a like plurality of digital to analog converters (D/A) 92. LL 94 are loaded during calibration, in a manner described below, with digital control signals representing brightness values defining $2^n$ different levels of drain voltages. Such control values are converted by D/A 92 into the actual $2^n$ different levels of analog drain voltages that are transmitted to DEMUXes 90. Each DEMUX is operative to drive one of the voltage levels present at the outputs of 92, onto the drain line 88 connected thereto so as to drive a PEL within the column which receives an active gate signal, to a brightness level dependent on the value of the DATA signal applied to such DEMUX. LL 94 are loaded with values transmitted from calibration system 96 during the calibration process as described in more detail hereinafter.

Figure 3:
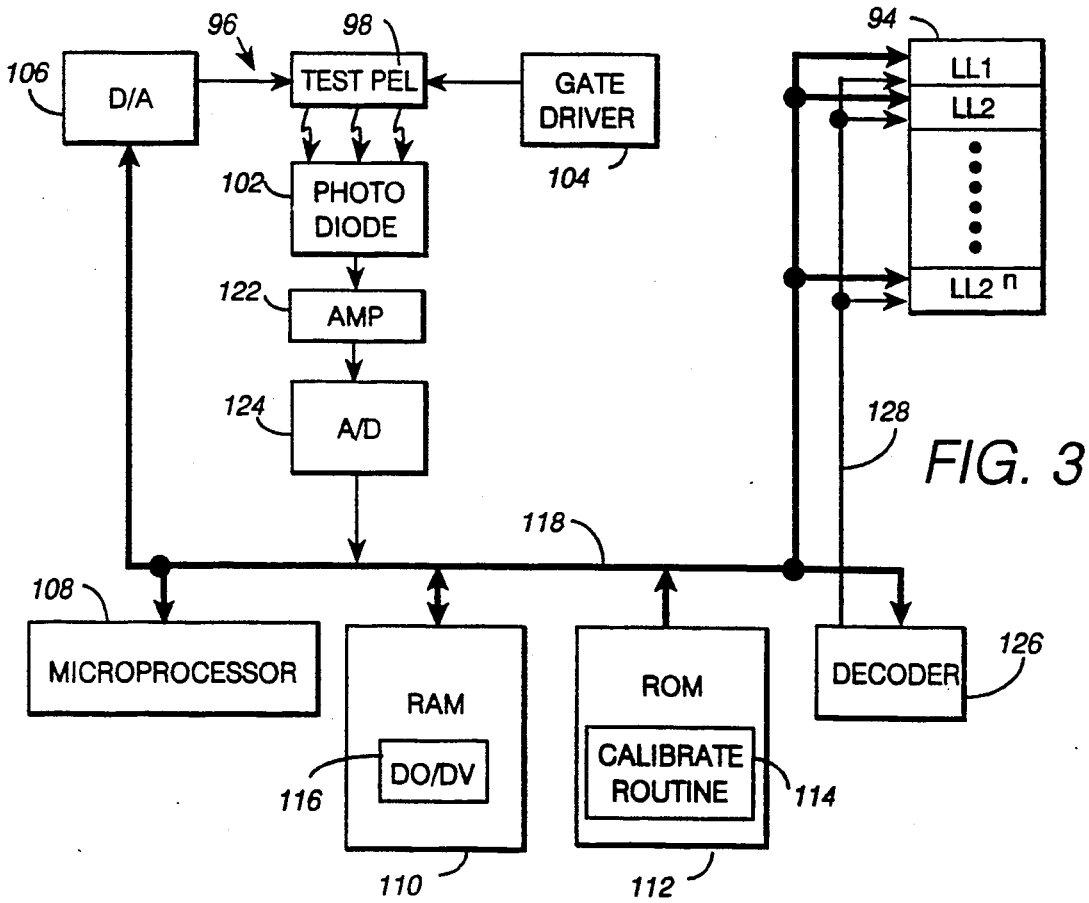
FIG. 3 is a block diagram showing primarily the calibration system of the LCD subsystem shown in FIG. 2.

LCD 64 also includes an opaque mask 100 surrounding the above described matrix of PELS, and a test PEL 98 is located behind the mask out of sight of a user. The test PEL is connected to calibration system 96 and actuates a photodiode 102 as shown in FIG. 3, to which figure reference will now be made. Test PEL 98 is formed at the same time as the viewable PELs and has the same characteristics thereof so as to provide a reliable test for calibrating the display. Photodiode 102 is shaped and located so as to receive light emitted by PEL 98 and produce an output voltage indicative of the brightness of such light. PEL 98 receives a gate signal from a gate driver 104 and drain signals from a D/A converter 106, during calibration. Converter 106 has the same conversion characteristics as those of converter 92 so that the analog output values thereof will be the same for a given digital input value. Gate driver 104 is a free running oscillator that matches the frequency and duty cycle of a viewable PEL. During calibration, the test PEL is driven at the same refresh frequency as is a viewable PEL to provide a direct correlation of the characteristics of the test PEL with those of the viewable PELs. When a given display is manufactured, it is expected that there might be some slight variations in the characteristics of the individual PELs therein. The use of a single test PEL should provide acceptable test accuracy, but it is within the scope of the invention to use plural test PELs and average the results to achieve greater accuracy.

Calibration system 96 further includes a digital data processing system having a microprocessor 108 connected by a bus 118 to a RAM 110, ROM 112, decoder 126 and a digital-to-analog converter (D/A) 106. ROM 112 stores a calibrate program or routine 114 which is selectively executable in microprocessor 108 to effect calibration. Calibration may be done when the LCD is first powered on, or when processor 12 (FIG. 1) executes POST program 40 and passes self test control to the display system. In a situation where the technology of the display might be such that variations in temperature, atmospheric pressure, etc. affect the display, calibration could be done dynamically in response to changes in such conditions. During calibration, the analog outputs (DO) of photodiode 102 are amplified in an amplifier 122 and then digitized in an analog-to-digital converter (A/D) 124 for transmission over bus 118 for storage in table 116. Table 116 also stores the digital test values (DV) that produced the respective analog values DO.

Figure 4:
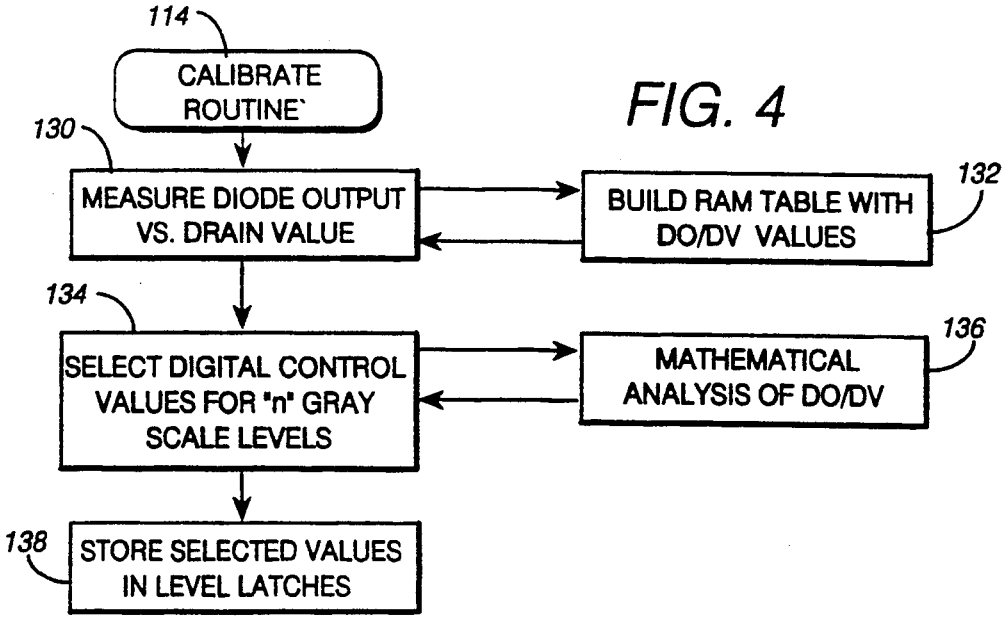
FIG. 4 is a general flow diagram of the calibration process used in the invention.

Calibration system 96 operates in a test mode and in a tristate mode. During test mode, system 96 is effectively connected to Lls 94 to first run the calibration test and then load the level latches whereupon system 96 is switched to the tristate mode and effectively "disconnects" from LLs 94 allowing the digital control values stored therein to provide the desired gray scale levels for operating LCD 64. Referring to FIG. 4, when calibration routine 114 is executed by processor 108, step 130 measures the output voltage of photodiode 102 as a function of a series of test drain voltage values applied to test PEL 98. Such measurement entails building table 116 in RAM 114 and storing values for the test drain voltages DV versus photodiode output DO. The number of test values or samples taken during the test is greater (e.g., by a factor of 100) than the number of levels of gray values which is predetermined for a given display system. This optimizes the intensity of gray shades.

Next, step 134 then selects the different control values to be loaded into LL 94 to produce "n" gray scale levels of drain voltages, the selection being determined by step 136 in which a mathematical analysis is made of the photodiode output versus test drain voltage inputs into PEL 98. Such analysis is preferably made using either one of the following two formulas or equations:

$$X(y+1)=X(y)*\sqrt{2} \qquad \text{(Egn. 1)}$$

where

X(y+1)=diode output for the (y+1) level of gray scale,

X(y)=diode output for the (y) level of gray scale level but where X(1) is the minimum diode output detected during the test, y is a value ranging from 1 to "n", and "n" is the number of gray scale levels.

The number n=ln(CR)/((ln 2)/2) where "CR" is the contrast ratio and "ln" is the standard natural log with "n" being rounded down to the nearest integer.

$$X(y+1)=X(y)*e^{ln\ CR/n} \qquad \text{(Eqn. 2)}$$

where e=natural log base and all other terms are as previously defined.

The use of Eqn. 1 produces a gray scale step ratio of approximately 1.4 which is considered to be the minimum ratio for a human to distinguish between adjacent brightness or gray scale levels. The use of Eqn. 2 produces a step ratio greater than 1.4 so that the resultant displays look "snappier" and have more distinguishable contrasts between adjacent levels. Once the diode step levels have been determined, table 118 is then accessed to lookup the DV values which produced such levels, and step 138 then stores the selected digital values as digital control values in LL 94. This is accomplished by sending the digital control values over bus 118 to the latches in conjunction with timed latching signals sent from decoder 126 by lines 128. During normal operation after completion of calibration, the various levels of drain line voltages are applied to the PELS repetitively as fixed width pulses by PAM to produce the different gray scales.

While the foregoing detailed calibration process is described relative to a monochromatic LCD, it should be obvious to those skilled in the art that the procedure can be applied to colored LCDs by calibrating the red, green and blue (R,G, and B) liquid crystals in a similar manner. It should also be apparent to those skilled in the art that other changes can be made in the details and arrangements of steps and parts without departing from the scope of the invention a defined in the appended claims.

What is claimed is:

1. A thin film transistor (TFT) liquid crystal display (LCD) system having a run mode of operation and a calibration mode of operation, said LCD system comprising:

a matrix of viewable picture elements (PELs), each PEL comprising liquid crystal material coupled with a TFT and operative to transmit light to a degree controllable by a drain voltage applied to such TFT;

a plurality of N digitally controlled voltage sources connected to said matrix for supplying different levels of drain voltages to said viewable PELs to produce in said viewable PELs N different gray scale levels, each voltage source comprising a register for storing a digital voltage value establishing the value of drain voltage to be produced by said each voltage source, and a digital-to-analog converter connected to said register for converting said digital voltage value stored in said register into an analog value of drain voltage;

control means connected to said voltage sources and to said viewable PELs for controlling which voltage source supplies a drain voltage to each viewable PEL;

a test PEL having characteristics substantially the same as those of said viewable PELs, said test PEL comprising a gate line and a drain line;

and selectively operated calibration means connected to said test PEL and to said voltage sources for measuring said characteristics of said test PEL and setting said voltage sources to produce N different levels of drain voltages and thereby provide N gray scale levels for said viewable PELs, said calibration means being operative during said calibration mode and comprising a photodiode positioned adjacent said test PEL for measuring light transmitted therethrough and producing an output signal proportional thereto, a test digital-to-analog converter (DAC) connected to said drain line of said test PEL for applying drain voltage test signals to said test PEL, said test DAC having characteristics the same as the characteristics of said digital to analog converters in said voltage sources, a gate driver connected to said gate line of said test PEL and operative to generate gate signals concurrent with said drain voltage test signals, means, including an analog-to-digital converter (ADC), connected to said photodiode and to said DPS for converting analog output signals from said photodiode into digital output values (DOs) and storing such DOs in said memory, and a digital data processing system (DPS) including a processor, and a memory connected to said processor for storing a calibration routine and measurement results, said DPS being connected to said registers in said voltage sources and to said ADC;

said DPS being operative, in response to execution of said calibration routine by said processor during said calibration mode, to measure characteristics of said test PEL by storing in said memory a test series of different digital drain voltage test signals (DVs) and transmitting said DVs to said test DAC to thereby actuate said test PEL and produce said DOs, said series of DVs encompassing a range extending from minimum transmissivity of said test PEL to maximum transmissivity of said test PEL and includes a plurality of test signals that greatly exceeds the number of gray scale levels, and by receiving said DOs from said ADC and storing said DOs in said memory at locations corresponding to the respective ones of said DVs which produced said DOs;

and said DPS being further operative in response to execution of said calibration routine by said processor to analyze said signals stored in said memory and locate N ascending values of DOs where each higher DO so located differs from a lower preceding value by a ratio of at least 1.4, where N is determined from the relationship $N=\ln(CR) / ((\ln 2)/2)$, and CR=(maximum transmissivity/minimum transmissivity) of said test PEL, N being rounded down to nearest integer, and store in said registers of said voltage sources the ones of DVs corresponding to the N values of ascending DOs so located.

2. An LCD system in accordance with claim 1 wherein: said viewable PELs in said matrix are arranged in rows and columns, and said LCD system further comprises:

a plurality of demultiplexers having outputs connected to drive lines of said viewable PELs and inputs connected to said variable voltage sources and to a source of data signals each containing a gray scale value for a given PEL whereby such gray scale value determines which drain voltage level is applied to such given PEL.

3. An LCD system in accordance with claim 2 wherein said source of data signals comprises a video random access memory for storing said data signals.

4. An LCD system in accordance with claim 3 comprising:

timing means connected to said VRAM for receiving said data signals therefrom and controlling drain voltage signals applied to said PELs so as to repetitively refresh each PEL for a predetermined fixed duration each time a drain voltage level is applied to each PEL

5. An LCD system in accordance with claim 1 wherein said ratio equals $e^{\ln CR/N}$ where e=natural log base.

* * * * *